US009803534B2

(12) United States Patent
Marutani et al.

(10) Patent No.: US 9,803,534 B2
(45) Date of Patent: Oct. 31, 2017

(54) COOLING STRUCTURE OF MULTI-CYLINDER ENGINE

(71) Applicant: Mazda Motor Corporation, Aki-gun, Hiroshima (JP)

(72) Inventors: Yusuke Marutani, Hiroshima (JP); Tomohiro Koguchi, Higashihiroshima (JP); Haruki Misumi, Hiroshima (JP); Shinji Wakamoto, Hatsukaichi (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 93 days.

(21) Appl. No.: 14/723,214

(22) Filed: May 27, 2015

(65) Prior Publication Data

US 2015/0345363 A1 Dec. 3, 2015

(30) Foreign Application Priority Data

May 30, 2014 (JP) ..... 2014-112352

(51) Int. Cl.
*F01P 3/02* (2006.01)
*F02F 1/14* (2006.01)
(Continued)

(52) U.S. Cl.
CPC *F01P 3/02* (2013.01); *F02F 1/14* (2013.01); *F02F 1/166* (2013.01); *F01P 5/12* (2013.01)

(58) Field of Classification Search
CPC ..... F01P 3/02; F01P 5/12; F02F 1/14; F02F 1/166
(Continued)

(56) References Cited

U.S. PATENT DOCUMENTS 5,092,283 A * 3/1992 Holt ..... F01P 3/02 123/41.74
7,438,026 B2 * 10/2008 Nakada ..... F01P 3/02 123/41.74
(Continued)

FOREIGN PATENT DOCUMENTS

JP 2008128133 A 6/2008
JP 2009243414 A 10/2009
(Continued)

*Primary Examiner* — Joseph Dallo
*Assistant Examiner* — Yi-Kai Wang
(74) *Attorney, Agent, or Firm* — Alleman Hall Creasman & Tuttle LLP

(57) ABSTRACT

A cooling structure of a multi-cylinder engine is provided. The engine has cylinders and a cylinder block formed with a cylinder bore wall. The cooling structure includes a water jacket formed in the cylinder block and defined by the cylinder bore wall and a jacket outer surface surrounding the cylinder bore wall, a water pump for feeding a coolant to the water jacket, an introduction portion formed in the cylinder block, having an introduction port opening to the jacket outer surface, and for introducing the coolant to the water jacket, and a spacer member accommodated inside the water jacket. The spacer member has a spacer main body surrounding the cylinder bore wall, and a dividing wall protruding toward the jacket outer surface from an outer circumferential surface of the spacer main body. The dividing wall extends in a circumferential direction at a position opposing the introduction port.

10 Claims, 10 Drawing Sheets

(51) Int. Cl.
*F02F 1/16* (2006.01)
*F01P 5/12* (2006.01)

(58) Field of Classification Search
USPC ..... 123/41.44
See application file for complete search history.

(56) References Cited

U.S. PATENT DOCUMENTS

| | | | | |
|---|---|---|---|---|
| 8,171,896 | B2 | 5/2012 | Hanai et al. | |
| 2002/0000210 | A1* | 1/2002 | Shinpo | F01P 3/02 123/41.74 |
| 2009/0194046 | A1* | 8/2009 | Shikida | F02F 1/14 123/41.74 |
| 2009/0266315 | A1* | 10/2009 | Hanai | F02F 1/16 123/41.72 |
| 2015/0159540 | A1* | 6/2015 | Misumi | F02F 1/16 123/41.44 |
| 2015/0377114 | A1* | 12/2015 | Matsumoto | F02F 1/14 123/41.44 |

FOREIGN PATENT DOCUMENTS

| | | | |
|---|---|---|---|
| JP | 2009264286 | A | 11/2009 |
| JP | 4547017 | B2 | 9/2010 |
| JP | 2012237273 | A | 12/2012 |

* cited by examiner

COOLING STRUCTURE OF MULTI-CYLINDER ENGINE

BACKGROUND

The present invention relates to a cooling structure of a multi-cylinder engine, which includes a cylinder block formed with a plurality of cylinders and a water jacket surrounding a cylinder bore wall of the cylinders.

Conventionally, as a cooling structure of an engine, a structure is known, in which a water jacket is formed in a cylinder block to surround a cylinder bore wall and a coolant fed from a water pump is introduced into the water jacket to cool the engine.

Moreover, to improve cooling performance and the like, providing a spacer member inside the water jacket to define an internal space of the water jacket has been discussed. JP4547017B discloses such a structure. Specifically, in the structure of JP4547017B, an introduction section for introducing a coolant fed from a water pump into a water jacket is provided in a cylinder block, and a spacer member provided with a plate-shaped restricting member opposing an opening of the introduction section and extending in up-and-down directions of the cylinder block is accommodated in the water jacket. In this structure, when the coolant flows into the water jacket from the introduction section, the coolant is suppressed from flowing to an intake-side part of the cylinder block and the cylinder head side without passing through an exhaust-side part of the cylinder block, and thus, a flow rate of the coolant flowing through the exhaust-side part of the cylinder block is secured, which leads to efficiently cooling the engine.

According to the structure of JP4547017B, it can be thought that the exhaust-side part of the cylinder block where the temperature easily becomes comparatively high can be efficiently cooled and a temperature difference between the exhaust-side and intake-side parts can be reduced. However, with this structure, a temperature difference between cylinders which occurs when the coolant flow inside the water jacket is stopped while the water pump is driven cannot be reduced, which causes a disadvantage of varying combustion states between the cylinders due to the temperature difference.

Specifically, in a case where a water pump which is forcibly driven by the engine is used as the water pump for feeding the coolant to the water jacket, even if the coolant flow inside the water jacket is stopped by, for example, closing an exit of the water jacket so as to increase the temperature of the cylinders and the like, the water pump is driven due to an operation of the engine, creating a state where the coolant is stirred near a part of the water jacket communicating with the water pump but is not stirred in other parts. Thus, the temperature difference occurs between a cylinder near a part communicating with the water pump and a different cylinder. In other words, near the part communicating with the water pump, due to the stirring, a high temperature coolant existing in a part of the cylinder block on the cylinder head side where the temperature is high in the cylinder block (i.e., the part close to a combustion chamber) causes a convective flow with a comparatively low temperature coolant existing in a part on an opposite side from the cylinder head (i.e., the part far from the combustion chamber). Therefore, the temperature of the part of the cylinder near the combustion chamber becomes lower than the other cylinders, and the temperature of the part of the cylinder far from the combustion chamber becomes higher than the other cylinders.

SUMMARY

The present invention is made in view of the above situations and aims to provide a cooling structure of a multi-cylinder engine, which is able to reduce a temperature difference between cylinders.

According to one aspect of the present invention, a cooling structure of a multi-cylinder engine is provided. The engine has a cylinder block formed with a plurality of cylinders and a cylinder bore wall of the plurality of cylinders. The cooling structure includes a water jacket formed in the cylinder block and defined by the cylinder bore wall and a jacket outer surface surrounding the cylinder bore wall, a water pump for feeding a coolant to the water jacket by being driven by the engine, an introduction portion formed in the cylinder block, having an introduction port opening to the jacket outer surface, and for introducing, to the water jacket, the coolant fed by the water pump, and a spacer member accommodated inside the water jacket. The spacer member has a spacer main body surrounding the cylinder bore wall, and a dividing wall protruding toward the jacket outer surface from an outer circumferential surface of the spacer main body. The dividing wall extends in a circumferential direction of the spacer main body at a position opposing the introduction port, so as to partition at least a part of a space between the introduction port and the outer circumferential surface of the spacer main body into a cylinder head side space and a space on an opposite side from the cylinder head.

According to this configuration, the dividing wall protruding toward the jacket outer surface from the spacer main body and extending in the circumferential direction is provided at the position opposing the introduction port of the introduction portion communicating with the water pump, and the space between the introduction port and the outer circumferential surface of the spacer main body is partitioned by the dividing wall into the cylinder head side space and the space on the opposite side from the cylinder head. Therefore, the stirring of the coolant due to an operation of the water pump can be suppressed and, at a position near the introduction port of the introduction portion communicating with the water pump, the coolant in a part of the water jacket on the cylinder head side where the temperature is comparatively high causes a convective flow with the coolant in a part of the water jacket on the opposite side from the cylinder head where the temperature is comparatively low. Thus, a temperature difference caused between a cylinder disposed near the introduction port and the rest of the cylinders can surely be reduced.

The dividing wall is preferably disposed to oppose an end part of the introduction port on a cylinder head side.

Thus, influence of the stirring by the water pump can be contained within the space on the opposite side from the cylinder head, and the convective flow of the coolant between the cylinder head side and the opposite side from the cylinder head can surely be suppressed to be weak.

Moreover, the plurality of cylinders are preferably aligned in a predetermined cylinder aligning direction. The introduction port is preferably formed outward of one of the cylinders disposed at an end among the plurality of cylinders in the cylinder aligning direction. The spacer member preferably has a flow splitting wall, a first vertical wall, and a second vertical wall. Each of the flow splitting wall, the first vertical wall, and the second vertical wall preferably protrudes toward the jacket outer surface from a part of the outer circumferential surface of the spacer main body. The part opposes the introduction port. The flow splitting wall preferably has a shape which extends in the circumferential direction of the spacer main body, at a position further toward the opposite side from the cylinder head than the dividing wall. The first vertical wall preferably has a shape which extends toward the dividing wall from the flow splitting wall. The second vertical wall preferably has a shape which extends to the opposite side from the cylinder head, from the flow splitting wall. The first and second vertical walls are preferably disposed to be separated from each other in the cylinder aligning direction.

Thus, by the flow splitting wall in addition to the dividing wall, the space between the introduction port and the outer circumferential surface of the spacer main body is partitioned into the cylinder head side space and the space on the opposite side from the cylinder head, and the convective flow caused by the coolant on the cylinder head side and the coolant on the opposite side from the cylinder head can be suppressed. Therefore, the temperature difference between the cylinders can surely be reduced. Further, the coolant introduced into the water jacket from the introduction port can be split into both sides of the water jacket in the cylinder aligning direction by the dividing wall, the flow splitting wall, and the first and second vertical walls. Therefore, the engine can effectively be cooled. Particularly since the introduction port is disposed outward of the cylinder disposed at the end among the plurality of cylinders in the cylinder aligning direction, coolant split to one of the sides of the cylinder aligning direction can be directed to one side of a direction perpendicular to the cylinder aligning direction, and coolant split to the other side of the cylinder aligning direction can be directed to the other side of the direction perpendicular to the cylinder aligning direction. Thus, the engine can more effectively be cooled.

Moreover, the spacer member preferably has a partition wall protruding toward the jacket outer surface from the outer circumferential surface of the spacer main body, extending in the circumferential direction of the spacer main body to surround substantially an entire circumference of the spacer main body, so as to form a coolant path where the coolant flows. The coolant path is preferably formed between the outer circumferential surface of the spacer main body and the jacket outer surface on the opposite side from the cylinder head.

Thus, the convective flow of the coolant formed between the cylinder head side and the opposite side from the cylinder head can also be suppressed by the partition wall, and the temperature difference between the cylinders can more surely be reduced.

Here, the partition wall is preferably formed continuously from the dividing wall.

Thus, the outer circumferential side space of the water jacket can entirely be partitioned into the cylinder head side space and the space on the opposite side from the cylinder head by the partition wall and the dividing wall, the convective flow of the coolant can be suppressed, and the temperature difference between the cylinders can more surely be reduced.

Moreover, the spacer main body preferably has a step part protruding toward the jacket outer surface from the outer circumferential surface of the spacer main body, and a part of the spacer main body on the cylinder head side with respect to the step part is disposed farther from the cylinders compared to a part of the spacer main body on the opposite side from the cylinder head side with respect to the step part. The step part preferably forms the partition wall. On the cylinder head side of the partition wall, a coolant path where the coolant flows is preferably formed between the inner circumferential surface of the spacer main body and an outer circumferential surface of the cylinder bore wall by the partition wall.

Thus, the partition wall can be provided with such a comparatively simple configuration and, in a part of the space of the water jacket on the cylinder side with respect to the spacer main body, a coolant path where the coolant flows can be secured in a part of the space that is close to the cylinder head and where the temperature becomes high, and the cylinder bore wall can effectively be cooled.

Moreover, the spacer main body preferably extends from an end of the water jacket on the opposite side from the cylinder head, to an end of the water jacket on the cylinder head side, so as to partition the entire water jacket into a cylinder side space and a space on an opposite side from the cylinders. In the spacer main body, introduction openings are preferably formed at positions opposing interval portions formed between cylinder bores of the cylinders. Each of the introduction openings preferably communicates a part of a space of the water jacket on the cylinder side with respect to the spacer main body to an other part of the space of the water jacket on the opposite side from the cylinder with respect to the spacer main body.

Thus, an internal space of the water jacket can entirely be partitioned into the cylinder head side space and the space on the opposite side from the cylinder head by the spacer main body. Therefore, the influence of the stirring caused on the opposite side from the cylinder with respect to the spacer main body by the water pump and the convective flow of the coolant caused by the stirring acting on the cylinder side, in other words, the cylinder bore wall, can be surely prevented. The temperature difference between cylinder bores of the cylinders caused by the convective flow can be reduced even more. Moreover, since the coolant is introduced into interval portions between the cylinder bores through any of the introduction openings, the interval portions between the cylinder bores where the temperature easily becomes high can effectively be cooled.

DETAILED DESCRIPTION OF EMBODIMENT

Hereinafter, a cooling structure of an engine according to one embodiment of the present invention is described with reference to the appended drawings.

(1) Overall Configuration

Figure 1:
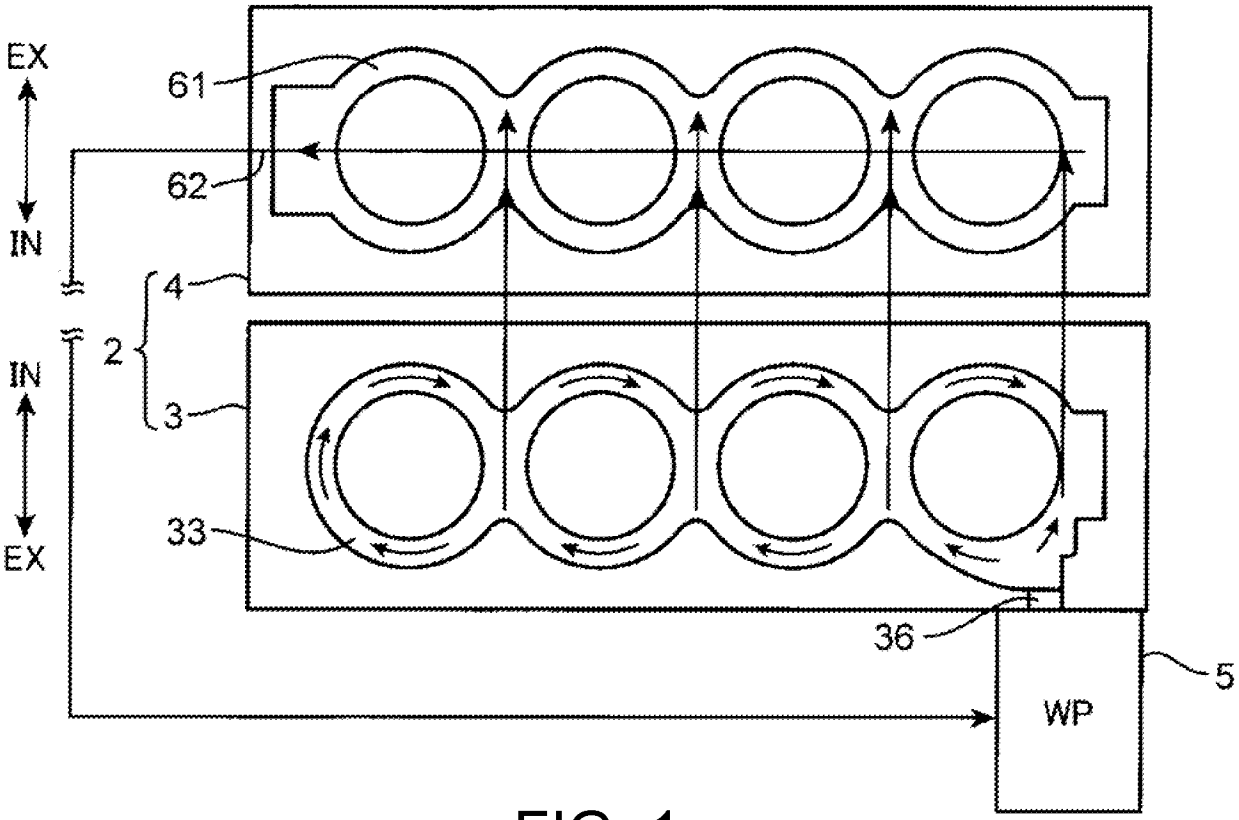
FIG. 1 is a view illustrating an overall configuration of a cooling device of a multi-cylinder engine according to one embodiment of the present invention.
Figure 2:
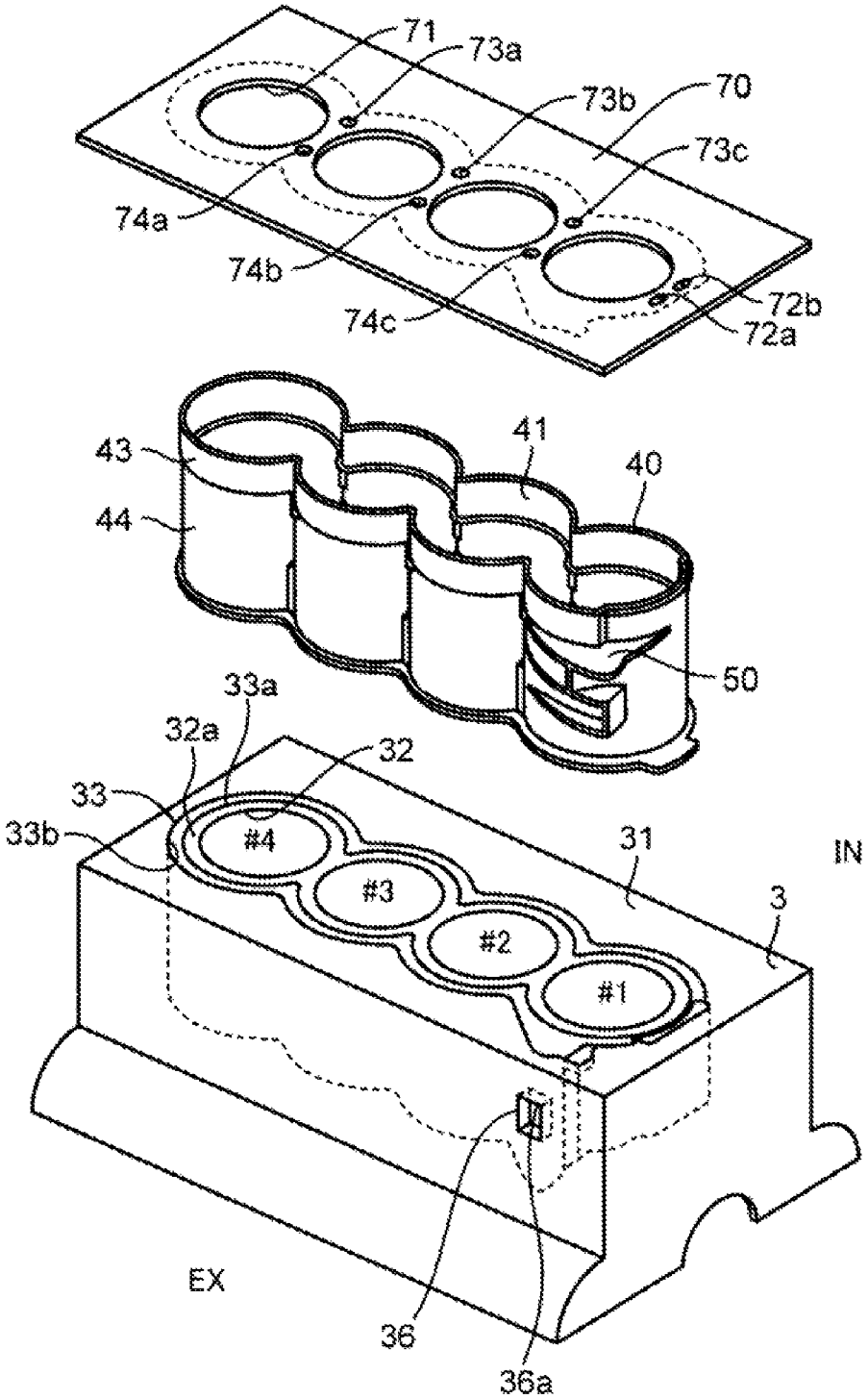
FIG. 2 is a schematic exploded perspective view of a cylinder block and other parts there-around.

As illustrated in FIG. 1, an engine 2 includes a cylinder block 3, and a cylinder head 4 fastened to the cylinder block 3 via a gasket 70 (see FIG. 2). In this embodiment, the engine 2 is an inline four-cylinder engine in which four cylinders (first to fourth cylinders #1 to #4) are aligned. In the cylinder block 3, four substantially-circular cylinders are formed to align in a predetermined direction (cylinder aligning direction). The engine 2 is a so-called crossflow engine, and an intake system of the engine 2 is provided on a side of a direction perpendicular to an axis of the cylinder aligning direction, and an exhaust system of the engine 2 is provided on the other side. In the appended drawings, "IN" indicates the intake side and "EX" indicates the exhaust side. Hereinafter, the axis of the cylinder aligning direction may suitably be referred to as left-and-right directions, in which the first cylinder #1 side is right and the fourth cylinder #4 side is left. Moreover, axial directions of each cylinder may be referred to as up-and-down directions, in which a cylinder head side is up and a side opposite from the cylinder head (counter cylinder head side) is down. A position defined in the up-and-down directions may be referred to a height position. A radially inward side of each cylinder may simply be referred to as an inner side and a radially outward side of the cylinder may simply be referred to as an outer side. Note that, in FIG. 1, the cylinder block 3 is seen from above, and the cylinder head 4 is seen from below, and therefore, the positional relationship between the intake and the exhaust sides is opposite between the cylinder block 3 and the cylinder head 4.

The cylinder block 3 and the cylinder head 4 are formed with water jackets 33 and 61 where a coolant flows, respectively. The engine 2 including the cylinder block 3 and the cylinder head 4 is suitably cooled by the coolant. Hereinafter, the water jacket 33 formed in the cylinder block 3 may be referred to as the block-side jacket 33, and the water jacket 61 formed in the cylinder head 4 may be referred to as the head-side jacket 61.

A water pump 5 that is forcibly driven by the engine 2 is attached to the cylinder block 3, and the coolant is fed to the water jackets 33 and 61 by the water pump 5. Specifically, the water pump 5 is coupled to a crankshaft (not illustrated) of the engine 2 and feeds the coolant as the crankshaft rotates, in other words, as the engine 2 operates.

An introduction section 36 communicating with a discharge port of the water pump 5 is formed in the cylinder block 3. The coolant discharged from the water pump 5 flows into the block-side jacket 33 from the introduction section 36. The coolant which has flowed into the block-side jacket 33 flows into the head-side jacket 61, is discharged outside of the engine 2 from a discharge port 62 formed in the cylinder head 4, and then suitably passes through a radiator (not illustrated) or the like to return to the water pump 5.

A valve (not illustrated) that is opened and closed according to an operation condition of the engine or the like is provided to the discharge port 62. By the opening/closing operation of the valve, the discharge of the coolant to the outside from the head-side jacket 61 is performed or stopped, which corresponds to allowing or stopping the flow of the coolant inside the water jackets 33 and 61. For example, in a case of increasing the temperature of the engine 2 in an early stage during a warm-up operation, the valve is closed to stop the flow of the coolant, and the cooling of the engine 2 by the coolant is prohibited.

(2) Cylinder Block

The structure of the cylinder block 3 is described in detail.

Figure 3:
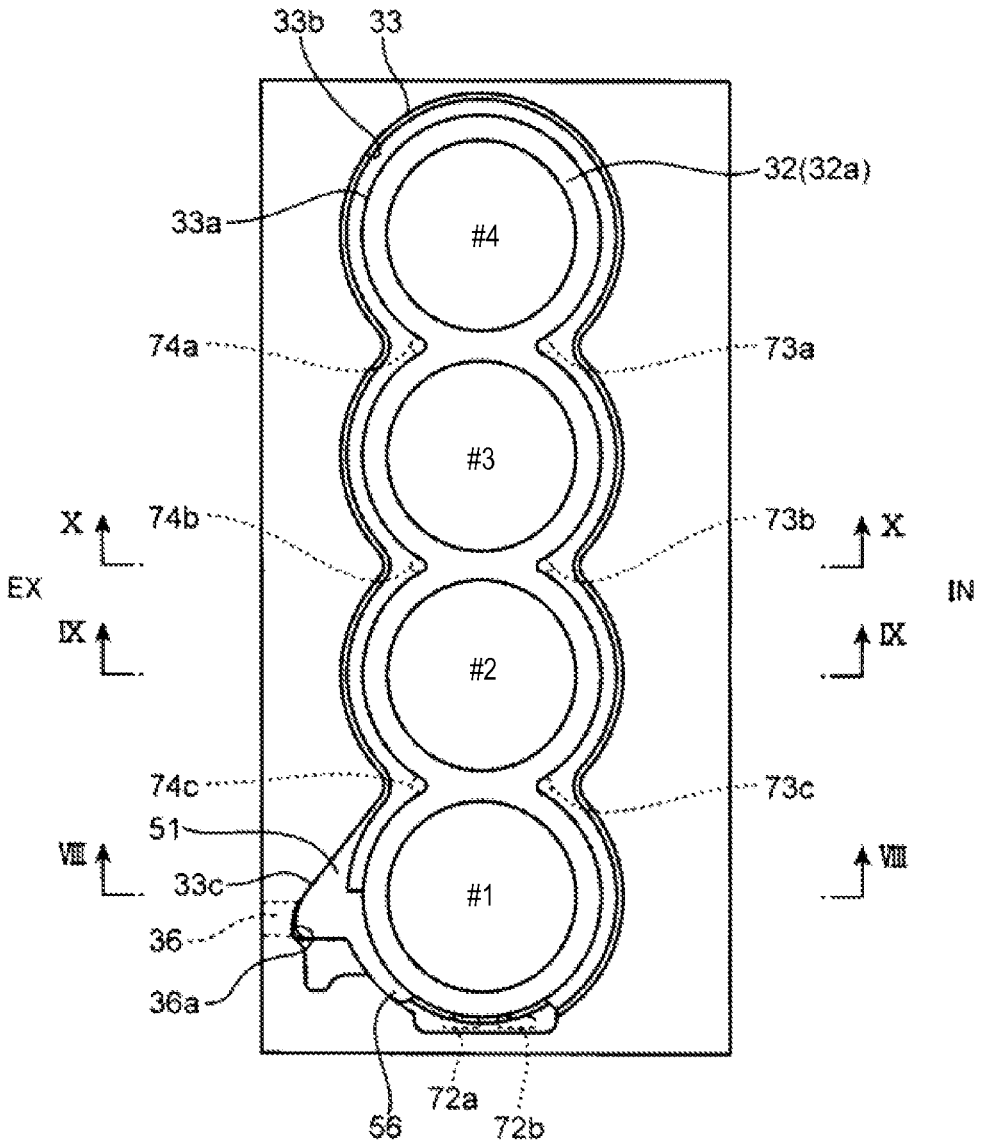
FIG. 3 is a schematic plan view of the cylinder block and other parts there-around.

FIG. 2 is a schematic exploded perspective view of the cylinder block 3 and other parts there-around. FIG. 3 is a schematic plan view of the cylinder block 3 and other parts there-around.

As described above, the four substantially-circular cylinders are formed in the cylinder block 3. Cylinder bores 32 of the respective cylinders are coupled to each other, and a cylinder bore wall 32*a* surrounding the four cylinders is formed in the cylinder block 3.

The water jacket 33 (i.e., the block-side jacket 33) formed in the cylinder block 3 is formed to surround the cylinder bore wall 32*a*. In other words, the block-side jacket 33 is defined by the cylinder bore wall 32*a* and a jacket outer surface 33*b* surrounding the cylinder bore wall 32*a*. The block-side jacket 33 forms a groove extending continuously in directions perpendicular to the up-and-down directions, and an upper end of the block-side jacket 33 is entirely opened to a top surface 31 of the cylinder block 3. A spacer 40 for partitioning an internal space of the block-side jacket 33 is inserted into the block-side jacket 33. The spacer 40 is described in detail later.

The introduction section 36 formed in the cylinder block 3 has an introduction port 36*a* opening to the jacket outer surface 33*b*, and the coolant fed from the water pump 5 is introduced into the block-side jacket 33 through the introduction section 36 and the introduction port 36*a*. In this embodiment, the introduction section 36 and the introduction port 36*a* are formed in an exhaust-side half of a rightward end part of the cylinder block 3. In other words, the introduction section 36 and the introduction port 36*a* are formed at a position on the exhaust side, outward of the first cylinder which is located at the rightward end (at an end in the cylinder aligning direction) among all the cylinders. Moreover, the introduction section 36 and the introduction port 36*a* are formed lower than the upper end of the cylinder block 3. In this embodiment, in the left-and-right directions, the introduction section 36 and the introduction port 36*a* are formed at a position corresponding to a central part of the first cylinder.

A part of the block-side jacket 33 near the introduction port 36*a* bulges outward (to the counter cylinder side, in other words, to the direction of separating from the cylinder), and a bulging portion 33*c* is formed in this part.

Specifically, as illustrated in FIGS. 2 and 3, in the jacket outer surface 33*b*, a part opposing intake-side and exhaust-side sections of the cylinder bores 32 of the second to fourth cylinders and a part opposing an intake-side section of the cylinder bore 32 of the first cylinder extend substantially in parallel to the cylinder bores 32 at a position close to the cylinder bore 32. On the other hand, in the jacket outer surface 33*b*, a part opposing an exhaust-side section of the cylinder bore 32 of the first cylinder bulges outward (i.e., in the direction of separating from the cylinder bore 32) while extending rightward from a position corresponding to an interval portion between the first and second cylinders. The bulging portion 33*c* extends to a position opposing a rightward end of the introduction port 36*a*. The jacket outer surface 33*b* curves to the cylinder bore 32 side at the rightward end of the introduction port 36*a*, and then further extends substantially in parallel to the cylinder bore 32. Note that, in the example of FIGS. 2 and 3, the jacket outer surface 33*b* is formed with a step portion slightly recessed downward near a right side of the upper end of the bulging portion 33*c* (the step portion formed to have a bottom surface at the same height as or higher than a first lateral wall 51 described later); however, the step portion may be omitted.

(3) Gasket

The structure of the gasket 70 is described in detail.

The gasket 70 is a metal sheet gasket formed by stacking a plurality of metal plates and then clinching them at a plurality of positions to integrate them. The cylinder block 3 and the cylinder head 4 are fastened by a plurality of head bolts (not illustrated) while sandwiching the gasket 70 there-between. Note that, the cylinder block 3 and the gasket 70 are formed with bolt holes which the head bolts are inserted into and engaged with. An illustration of the cylinder block 3 and the gasket 70 is omitted.

The entire shape of the gasket 70 corresponds to the top surface 31 of the cylinder block 3, and four circular openings 71 are formed in the gasket 70 at positions corresponding to the four cylinders.

In the gasket 70, a plurality of communication openings 72*a*, 72*b*, 73*a* to 73*c*, and 74*a* to 74*c* communicating the block-side jacket 33 to the water jacket 61 (head-side jacket 61) formed in the cylinder head 4 are formed to penetrate the gasket 70.

As illustrated in FIGS. 2 and 3, two of the communication openings (first communication openings 72*a* and 72*b*) are formed in a rightward end part of the gasket 70, at positions corresponding to the rightward end part of the block-side jacket 33.

Three of the communication openings (second communication openings 73*a* to 73*c*) are formed in an intake-side part of the gasket 70. More specifically, the second communication openings 73*a* to 73*c* are formed at positions corresponding to interval portions of the cylinder bores 32 and near the cylinder bores 32 in an intake-side half of the block-side jacket 33. In other words, among the second communication openings 73*a* to 73*c*, the leftmost second communication opening 73*a* is formed at a position corresponding to the intake-side half of the interval portion between the cylinder bores 32 of the third and fourth cylinders and near the cylinder bores 32, the second communication opening 73*b* at the center is formed at a position corresponding to the intake-side half of the interval portion between the cylinder bores 32 of the second and third cylinders and near the cylinder bore 32, and the rightmost second communication opening 73*c* is formed at a position corresponding to the intake-side half of the interval portion between the cylinder bores 32 of the first and second cylinders and near the cylinder bore 32.

Three of the communication openings (third communication openings 74*a* to 74*c*) are formed in an exhaust-side part of the gasket 70. More specifically, the third communication openings 74*a* to 74*c* are formed at positions corresponding to the interval portions of the cylinder bores 32 and near the cylinder bores 32 in an exhaust-side half of the block-side jacket 33. In other words, among the third communication openings 74*a* to 74*c*, the leftmost third communication opening 74*a* is formed at a position corresponding to the exhaust-side half of the interval portion between the cylinder bores 32 of the third and fourth cylinders and near the cylinder bores 32, the third communication opening 74*b* at the center is formed at a position corresponding to the exhaust-side half of the interval portion between the cylinder bores 32 of the second and third cylinders and near the cylinder bores 32, and the rightmost third communication opening 74*c* is formed at a position corresponding to the exhaust-side half of the interval portion between the cylinder bores 32 of the first and second cylinders and near the cylinder bores 32.

(4) Spacer

The structure of the spacer 40 accommodated inside the block-side jacket 33 is described in detail.

Figure 4:
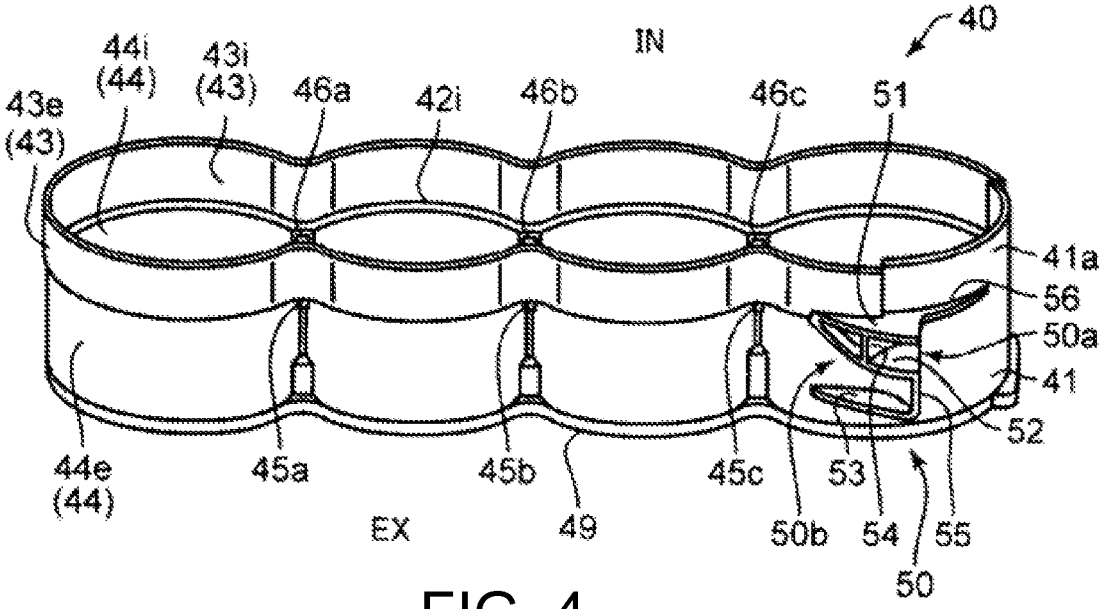
FIG. 4 is a perspective view of a spacer seen from an exhaust side.
Figure 5:
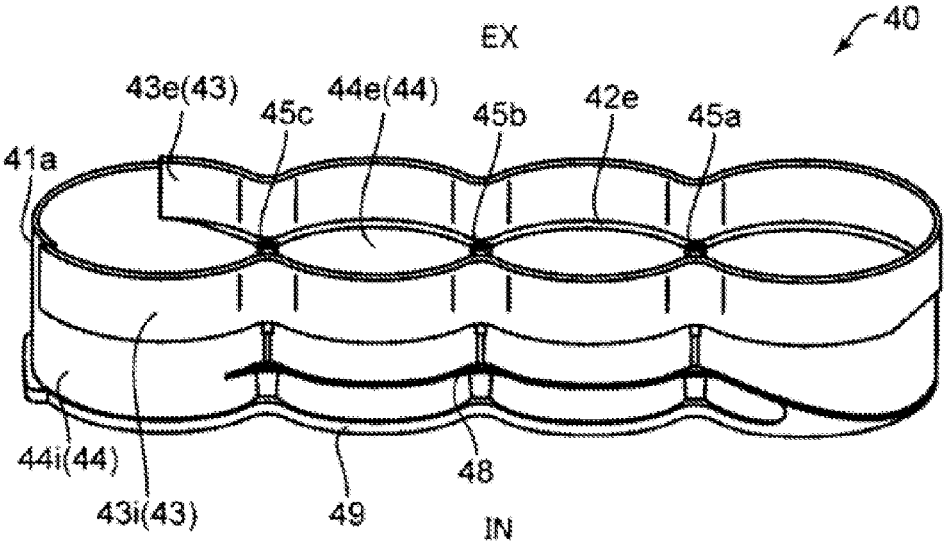
FIG. 5 is a perspective view of the spacer seen from an intake side.
Figure 6:
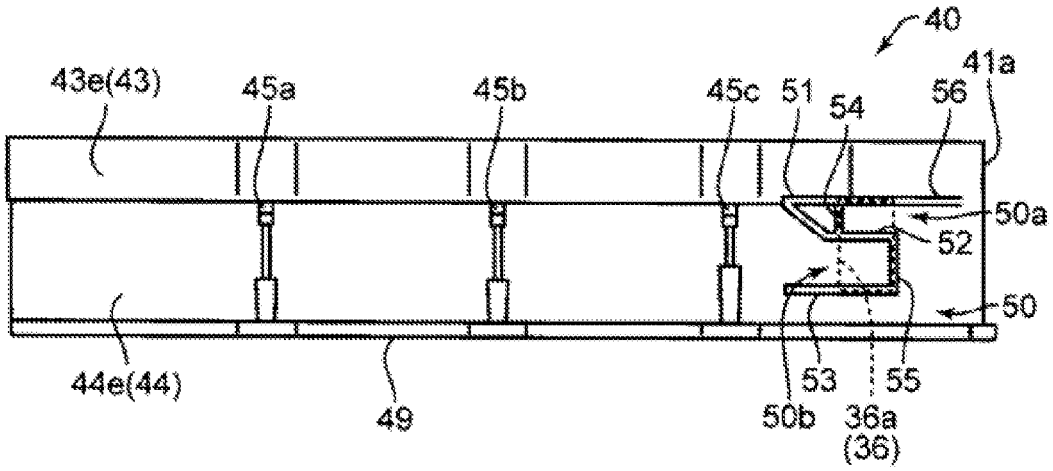
FIG. 6 is a side view of the spacer seen from the exhaust side.
Figure 7:
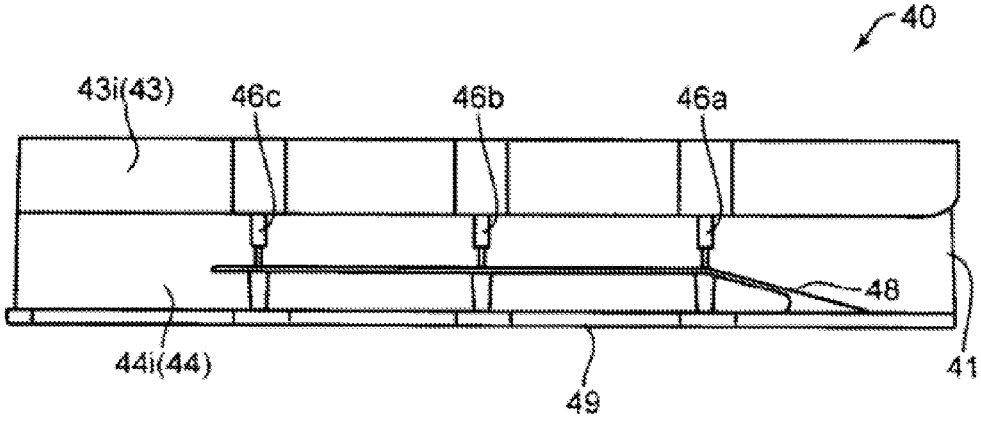
FIG. 7 is a side view of the spacer seen from the intake side.
Figure 8:
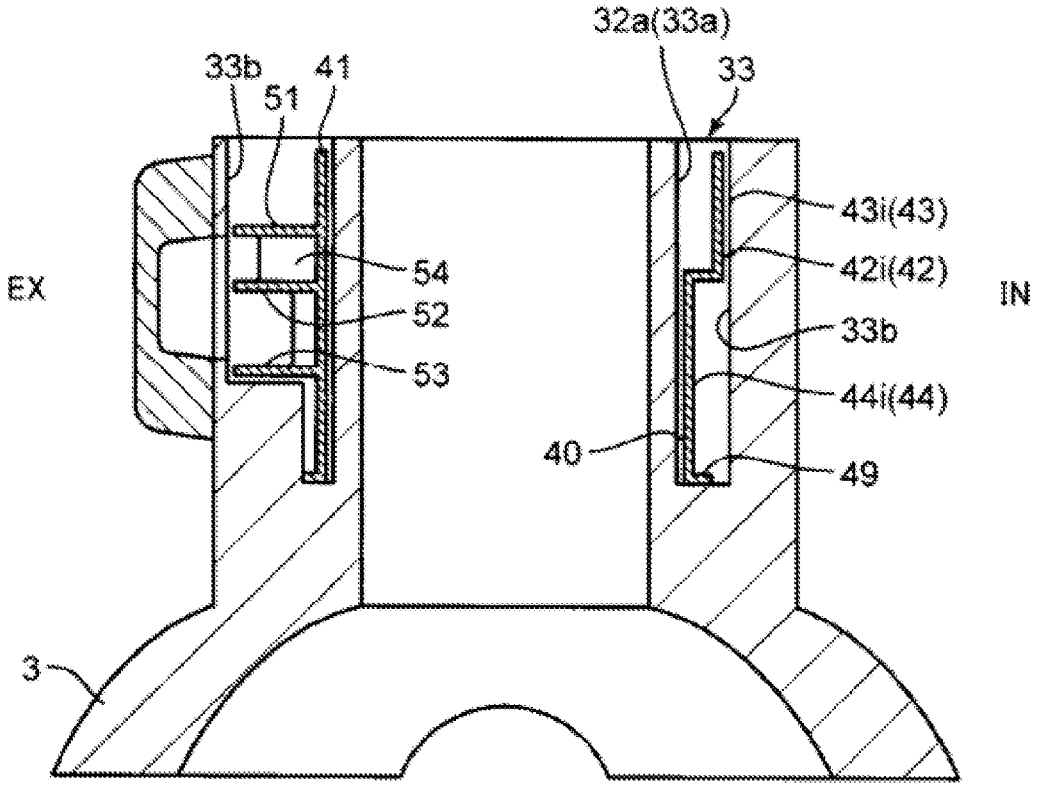
FIG. 8 is a cross-sectional view of FIG. 3 taken along a line VIII-VIII in FIG. 3.
Figure 9:
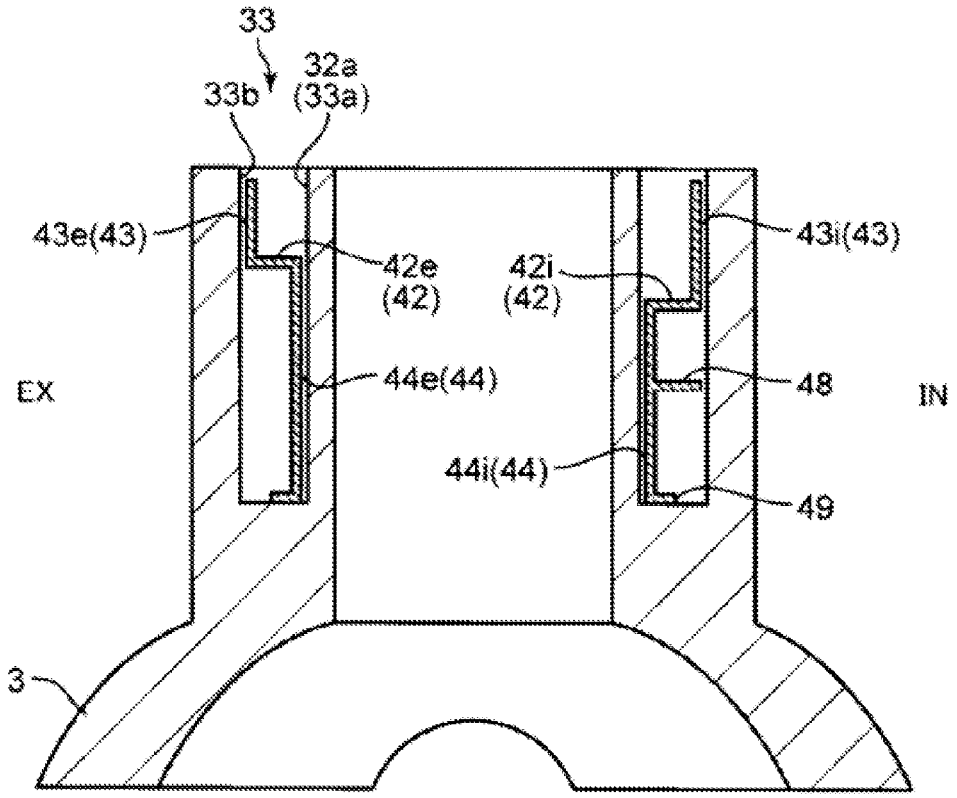
FIG. 9 is a cross-sectional view of FIG. 3 taken along a line IX-IX in FIG. 3.
Figure 10:
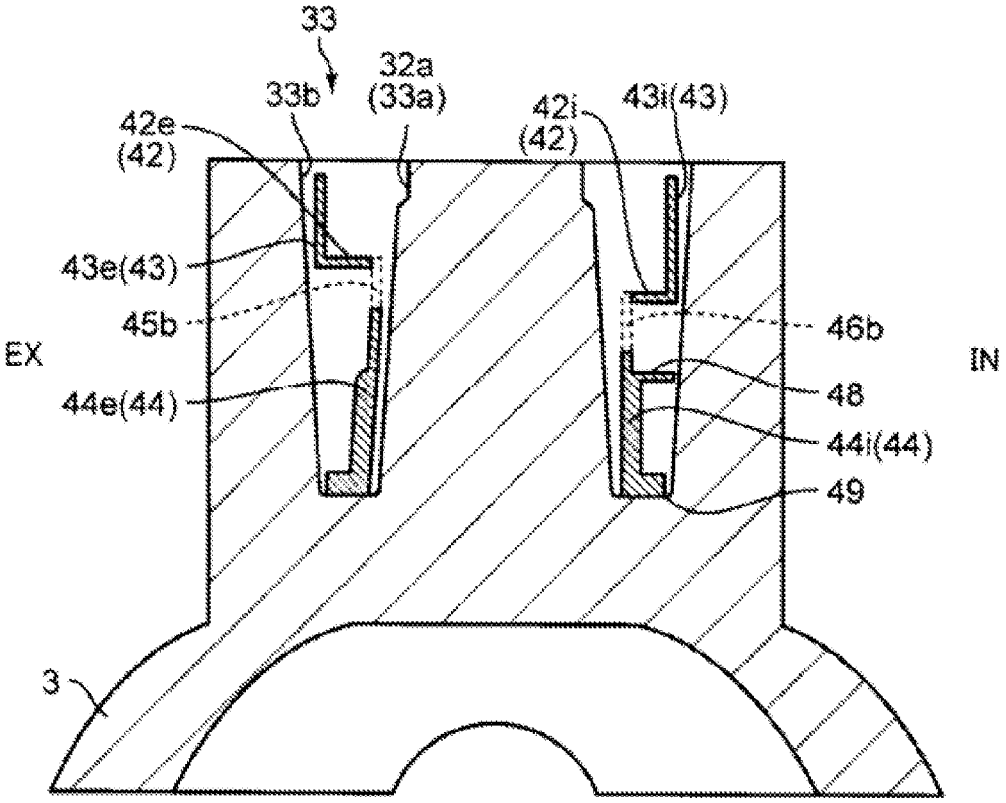
FIG. 10 is a cross-sectional view of FIG. 3 taken along a line X-X in FIG. 3.

FIG. 4 is a perspective view of the spacer 40 seen from the exhaust side. FIG. 5 is a perspective view of the spacer 40 seen from the intake side. FIG. 6 is a side view of the spacer 40 seen from the exhaust side. FIG. 7 is a side view of the spacer 40 seen from the intake side. FIG. 8 is a cross-sectional view of FIG. 3 taken along a line VIII-VIII in FIG. 3. FIG. 9 is a cross-sectional view of FIG. 3 taken along a line IX-IX in FIG. 3. FIG. 10 is a cross-sectional view of FIG. 3 taken along a line X-X in FIG. 3.

(4-1) Spacer Main Body

The spacer 40 has a spacer main body 41 surrounding an entire cylinder bore wall 32*a*. In this embodiment, the spacer main body 41 is a cylindrical member extending along the cylinder bore wall 32*a* continuously in directions perpendicular to the up-and-down directions, and has a shape, in plan view, of four circles aligned to slightly overlap with each other, and the spacer main body 41 surrounds an entire circumference of the cylinder bore wall 32*a*. The spacer main body 41 has an inner circumferential surface closely facing an outer circumferential surface 33*a* of the cylinder bore wall 32*a*, and an outer circumferential surface closely facing the jacket outer surface 33*b*. In other words, the spacer main body 41 extends in the up-and-down directions and has a certain thickness so as to be accommodated with a predetermined interval from the outer circumferential surface 33*a* of the cylinder bore wall 32*a* and a predetermined interval from the jacket outer surface 33*b* (i.e., a thickness thinner than the block-side jacket 33 which is a groove).

The spacer main body 41 has a length in the up-and-down directions that does not protrude from the top surface 31 of the cylinder block 3 (shorter than a depth of the block-side jacket 33 which is a groove). In this embodiment, the spacer main body 41 is designed such that its upper end is at substantially the same height as the top surface 31 of the cylinder block 3. Accordingly, the internal space of the block-side jacket 33 is partitioned into the inner (cylinder side) space and the outer (counter cylinder side) space by the spacer main body 41 over the entire circumference.

A flange 49 protruding toward the jacket outer surface 33*b* is formed over an entire circumference of a lower end part of the spacer main body 41. The spacer 40 is accommodated inside the block-side jacket 33 while the flange 49 contacts with the bottom surface of the block-side jacket 33.

A step part (partition wall) 42 is formed at a central position of the spacer main body 41 in the up-and-down directions. Specifically, an upper part 43 of the spacer main body 41 is positioned outward of a lower part 44 (on the counter cylinder side), and the step part 42 protruding outward from the lower part of the spacer main body 41 is formed at a boundary between the upper and lower parts 43 and 44. In this embodiment, the step part 42 is formed substantially over the entire circumference of the spacer main body 41. Specifically, the step part 42 is formed over the entire circumference except for a rightward end part 41*a* opposing the first communication openings 72*a* and 72*b* of the gasket 70 and a right-side part of a partition wall 50 (described later). Note that, the rightward end part 41*a* of the spacer main body 41 has a fixed distance from the outer circumferential surface 33*a* of the cylinder bore wall 32*a* entirely in the up-and-down directions, and extends in parallel to the outer circumferential surface 33*a*.

In this embodiment, the height position of an exhaust portion 42*e* of the step part 42 of the spacer main body 41 is different from that of an intake portion 42*i*, and the intake portion 42*i* is positioned lower. In other words, the length of an exhaust portion 43*e* of the upper part 43 in the up-and-down directions, which is on the upper side with respect to the step part 42 of the spacer main body 41, is shorter than that of an intake portion 43*i* of the upper part 43 in the up-and-down directions, which is on the upper side with respect to the step part 42 of the spacer main body 41. The length of an exhaust portion 44*e* of the lower part 44 in the up-and-down directions, which is on the lower side with respect to the step part 42 of the spacer main body 41, is longer than that of an intake portion 44*i* of the lower part 44 in the up-and-down directions, which is on the lower side with respect to the step part 42 of the spacer main body 41. Further, in a leftward end part of the spacer main body 41, the step part 42 inclines downward from the exhaust side to the intake side.

By such a configuration, in a lower space of the block-side jacket 33, a larger flow path area is secured for a path (i.e., coolant path) through which the coolant flows and which is formed between the exhaust-side half of the outer circumferential surface of the spacer main body 41 and the jacket outer surface 33*b* than a coolant path formed between the intake-side half of the outer circumferential surface of the spacer main body 41 and the jacket outer surface 33*b*, and cooling ability is improved on the exhaust side where the temperature becomes high. On the other hand, in an upper space of the block-side jacket 33, a coolant path between the intake-side half of the inner circumferential surface of the spacer main body 41 and the outer circumferential surface 33*a* of the cylinder bore wall 32*a* has a larger flow path area than a coolant path between the exhaust-side half of the inner circumferential surface of the spacer main body 41 and the outer circumferential surface 33*a* of the cylinder bore wall 32*a*.

In the spacer main body 41, as illustrated in FIGS. 4 to 7 and 10, a plurality of introduction openings 45*a* to 45*c* and 46*a* to 46*c* communicating the inner and outer sides of the spacer main body 41 within the block-side jacket 33 are formed to penetrate the spacer main body 41. The introduction openings 45*a* to 45*c* and 46*a* to 46*c* are openings for introducing, when the coolant is fed by the water pump 5 and made to flow into the part of the block-side jacket 33 on the outer side with respect to the spacer main body 41, the coolant into the part of the block-side jacket 33 on the inner side with respect to the spacer main body 41. As described above, in this embodiment, the entire internal space of the block-side jacket 33 is partitioned into the inner space and the outer space by the spacer main body 41. Therefore, the coolant fed by the water pump 5 and passed through the introduction section 36, first flows into the outer space of the block-side jacket 33 and then flows into the inner space through any of the introduction openings 45*a* to 45*c* and 46*a* to 46*c*.

In this embodiment, in the spacer main body 41, the introduction openings 45*a* to 45*c* and 46*a* to 46*c* are formed at positions opposing the interval portions of the cylinder bores 32 of the cylinders. Specifically, the first and second introduction openings 45*a* and 46*a* are formed in the spacer main body 41 at positions on the exhaust side and the intake side of the interval portion between the cylinder bores 32 of the third and fourth cylinders, respectively. The first and second introduction openings 45*b* and 46*b* are formed in the spacer main body 41 at positions on the exhaust side and the intake side of the interval portion between the cylinder bores 32 of the second and third cylinders, respectively. The first and second introduction openings 45*c* and 46*c* are formed in the spacer main body 41 at positions on the exhaust side and the intake side of the interval portion between the cylinder bores 32 of the first and second cylinders, respectively.

In plan view, the introduction openings 45*a* to 45*c* and 46*a* to 46*c* are formed at the same positions as the second and third communication openings 73*a* to 73*c* and 74*a* to 74*c* formed in the gasket 70. Specifically, the first introduction openings 45*a* to 45*c* formed in the exhaust-side half of the spacer main body 41 are formed at the positions corresponding to the third communication openings 74*a* to 74*c*, and the second introduction openings 46*a* to 46*c* formed in the intake-side half of the spacer main body 41 are formed at the positions corresponding to the second communication openings 73*a* to 73*c*, respectively.

Moreover, in this embodiment, a coolant guiding plate 48 protruding outward from the outer circumferential surface of the spacer main body 41 and extending in the left-and-right directions is provided to an intake-side part of the spacer main body 41. The coolant guiding plate 48 guides the coolant introduced to the intake-side part, to the cylinder head 4 side. The coolant guiding plate 48 inclines upward to the right from a leftward end part of the flange 49, and further extends substantially in parallel to the right direction at a certain height.

Moreover, in the spacer main body 41, the partition wall 50 protruding from the outer circumferential surface of the spacer main body 41 toward the jacket outer surface 33*b* is provided to the part within the bulging portion 33*c* of the block-side jacket 33, in other words, the part near the introduction port 36*a* and located outward on the exhaust side of the cylinder bore 32 of the first cylinder.

(4-2) Partition Wall

The partition wall 50 is described in detail.

The partition wall 50 includes a first lateral wall (dividing wall) 51, a second lateral wall (flow splitting wall) 52, a third lateral wall 53, a first vertical wall 54, and a second vertical wall 55. Each of the walls 51 to 55 protrudes from the outer circumferential surface of the spacer main body 41 toward the jacket outer surface 33*b*. Each of the walls 51 to 55 extends to a position near the jacket outer surface 33*b*.

As illustrated in FIGS. 4, 6, 8 and the like, the first, second and third lateral walls 51, 52 and 53 are plate members extending in the left-and-right directions. The first, second and third lateral walls 51, 52 and 53 are disposed in this order from the upper side. As illustrated in FIGS. 3, 4 and the like, the lateral walls 51 to 53 have substantially the same shape as the bulging portion 33*c* in plan view. In other words, each of the lateral walls 51 to 53 has a substantially triangle shape extending outward while extending rightward from the interval portion between the first and second cylinders. Specifically, each of the lateral walls 51 to 53 bulges outward from a position slightly rightward of the interval portion between the first and second cylinders, while extending to a position opposing the rightward end of the introduction port 36*a*. By such a configuration, the space of the bulging portion 33*c*, in other words, within the entire space between the outer circumferential surface of the spacer main body 41 and the jacket outer surface 33*b*, a part from the interval portion between the first and second cylinders to the rightward end of the introduction port 36*a* in the left-and-right directions, is partitioned into three vertically aligned spaces by the lateral walls 51 to 53. Specifically, the part from the interval portion between the first and second cylinders to the rightward end of the introduction port 36*a* is partitioned into a space higher than the first lateral wall 51, a space between the first and second lateral walls 51 and 52, and a space between the second and third lateral walls 52 and 53.

As illustrated in FIG. 6 and the like, the first lateral wall 51 is provided at the same height position as an upper end of the introduction port 36*a*, and extends in the left-and-right directions at this height position. Moreover, in this embodiment, the first lateral wall 51 continuously extends from the step part 42, and the step part 42 extends leftward from a left part of the first lateral wall 51.

An extension wall 56 extends rightward from a rightward end of the first lateral wall 51, continuously therefrom. Although the extension wall 56 also protrudes outward from the outer circumferential surface of the space main body 41, the protruding length thereof is smaller than that of the first lateral wall 51.

The second lateral wall 52 disposed below the first lateral wall 51 is disposed such that its right part opposes the introduction port 36*a*. In this embodiment, a right part of the first lateral wall 51 is provided at substantially a same height position as the central position of the introduction port 36*a* in the up-and-down directions, and extends in the left-and-right directions at this height position. On the other hand, a left part of the second lateral wall 52 inclines upward while extending leftward so as to connect, at its leftward end, with a leftward end of the first lateral wall 51.

The third lateral wall 53 disposed below the second lateral wall 52 is provided at the same height position as a lower end of the introduction port 36*a*. The third lateral wall 53 extends in the left-and-right directions at this height position fixedly.

As illustrated in FIGS. 4, 8 and the like, the first and second vertical walls 54 and 55 are plate members extending in the up-and-down directions.

Between the second and first lateral walls 52 and 51, the first vertical wall 54 extends in the up-and-down directions at a position opposing the introduction port 36*a*. In this embodiment, the first vertical wall 54 extends in the up-and-down directions, opposing the leftward end of the introduction port 36*a*.

Between the second and third lateral walls 52 and 53, the second vertical wall 55 extends in the up-and-down directions at a position opposing the introduction port 36*a*. In this embodiment, the second vertical wall 55 extends in the up-and-down directions, opposing the rightward end of the introduction port 36*a*.

By such a configuration, the part of the space which is between the outer circumferential surface of the spacer main body 41 and the jacket outer surface 33*b* and opposes the introduction port 36*a* is partitioned into the upper and lower spaces, and only the upper space communicates with the space on the right side of the introduction port 36*a*, and only the lower space communicates with the space on the left side of the introduction port 36*a*.

Specifically, in the upper space of the block-side jacket 33, the part opposing the introduction port 36*a* is defined by the first and second lateral walls 51 and 52 and the first vertical wall 54. This part is isolated from the left part of the space of the block-side jacket 33 by the first vertical wall 54, while it communicates with the right part of the space of the block-side jacket 33 through a section 50*a* formed between the rightward ends of the first and second lateral walls 51 and 52. Note that, the jacket outer surface 33*b* forming the bulging portion 33*c* as described above is bent to the cylinder bore 32 side at the rightward end of the introduction port 36*a*, and in this embodiment, in the section 50*a* between the rightward ends of the first and second lateral walls 51 and 52, only the part near the cylinder bore 32 of the first cylinder communicates only with the part of the space of the block-side jacket 33 on the right side of the introduction port 36*a* via a lower part of the extension wall 56.

Further, in the lower space of the block-side jacket 33, the part opposing the introduction port 36*a* is defined by the second and third lateral walls 52 and 53 and the second vertical wall 55. This part is isolated from the right part of the space of the block-side jacket 33 by the second vertical wall 55, while it communicates with the left part of the space of the block-side jacket 33 through a section 50*b* between the leftward ends of the second and third lateral walls 52 and 53.

(5) Flow Path of Coolant and Operation while Coolant Flows

By the configuration above, in this embodiment, when the water pump 5 is driven to allow the coolant to flow inside the block-side jacket 33 and the head-side jacket 61, the coolant flows as follows.

First, the coolant fed by the water pump 5 passes through the introduction section 36 and the introduction port 36*a* and flows into the block-side jacket 33. Here, a part of the coolant (the part that mainly flows through the upper half of the introduction section 36) flows into the space defined by the first and second lateral walls 51 and 52 and the first vertical wall 54, and passes through the section 50*a* between the rightward ends of the first and second lateral walls 51 and 52 to reach to a part of the space of the block-side jacket 33 on the right side of the introduction port 36*a*. The coolant then further passes through either one of the first communication openings 72*a* and 72*b* to enter into the head-side jacket 61.

On the other hand, a remainder of the coolant (the part that mainly flows through the lower half of the introduction section 36) flows into the space defined by the second and third lateral walls 52 and 53 and the second vertical wall 55, and passes through the section 50*b* between the leftward ends of the second and third lateral walls 52 and 53 to enter into the part of the space of the block-side jacket 33 on the left side of the introduction port 3*a*. The coolant then passes the exhaust-side half of the block-side jacket 33 to flow toward the left end of the block-side jacket 33.

Thus, in this embodiment, the coolant which entered from the introduction section 36 and the introduction port 36*a* is split in the left-and-right directions, and a part of the coolant (the part that flows rightward) is introduced into the head-side jacket 61 comparatively soon after entering, in other words, while its temperature is comparatively low, without passing through the exhaust-side half of the block-side jacket 33. Therefore, the cylinder head 4 is effectively cooled by the coolant. Note that, a flow rate of the split coolant is changeable based on a height position of the second lateral wall 52 and the like, and the second lateral wall 52 is disposed at a position at which a suitable predetermined flow rate of the split coolant can be obtained.

The coolant which has flowed into the left-side space (e.g., exhaust-side half) of the block-side jacket 33 after passing through the section 50*b* between the leftward ends of the second and third lateral walls 52 and 53, mainly passes through the coolant path formed lower than the step part 42 of the block-side jacket 33 and flows toward the leftward end of the block-side jacket 33. While flowing toward the leftward end of the block-side jacket 33, a part of the coolant flows into the part of the space of the block-side jacket 33 on the inner side with respect to the spacer main body 41 via any of the introduction openings 45*a* to 45*c*, then flows through the inner space, and passes through any of the third communication openings 74*a* to 74*c* to enter into the head-side jacket 61.

Thus, in this embodiment, the coolant flows into the inner side of the spacer main body 41 from any of the introduction openings 45*a* to 45*c* formed at the positions corresponding to the interval portions between the cylinder bores 32, and the coolant flows into the head-side jacket 61 from any of the third communication openings 74*a* to 74*c* formed at the positions corresponding to the interval portions between the cylinder bores 32. Thus, the parts around the interval portions between the cylinder bores 32 are effectively cooled. Moreover, the coolant which has flowed into the inner side of the spacer main body 41 mainly passes through the upper side of the step part 42, where the flow path area is secured. Therefore, an upper part of the cylinder bore wall 32*a*, which is close to the cylinder head 4 and where the temperature easily becomes high, can effectively be cooled.

Especially on the exhaust side, as described above, in the coolant path formed by the space between the outer circumferential surface of the spacer main body 41 and the jacket outer surface 33*b*, the flow path area of the part that is lower than the step part 42 and where the coolant passes first after entering from the introduction port 36*a* is secured to be larger than that on the intake side. Moreover, the coolant at a comparatively low temperature which has from the introduction port 36*a* flows through any of the introduction openings 45*a* to 45*c* formed at the positions corresponding to the interval portions between the cylinder bores 32. Thus, the exhaust-side half of the cylinder bore wall 32*a* where the temperature easily becomes high is effectively cooled.

On the other hand, the coolant which has reached the left end of the block-side jacket 33 flows to the intake side of the block-side jacket 33 and, while remaining on the outer side of the spacer main body 41, flows toward the right end. Also in the intake-side half of the block-side jacket 33, on the outer side of the spacer main body 41, the coolant mainly passes through the coolant path formed lower than the step part 42 of the block-side jacket 33. However, on the intake side, the coolant is guided upward by the coolant guiding plate 48. Here, the flow rate of the coolant decreases as the coolant flows away from the introduction port 36*a*. On the other hand, in this embodiment, since the coolant guiding plate 48 guides the coolant upward and the flow path where the coolant passes is narrowed, the decrease of the flow rate of the coolant can be suppressed. Thus, the flow rate of the coolant flowing into the interval portions between the cylinder bores 32 from any of the second introduction openings 46*a* to 46*c* can be secured, and the parts close to the cylinder head 4 can effectively be cooled while maintaining the cooling ability at the interval portions between the cylinder bores 32.

In this embodiment, also on the intake side, as described above, the coolant flows into the inner side of the spacer main body 41 from any of the introduction openings 46*a* to 46*c* formed at the positions corresponding to the interval portions between the cylinder bores 32, and the coolant then flows into the head-side jacket 61 from any of the second communication openings 73*a* to 73*c* formed at the positions corresponding to the interval portions. Therefore, the interval portions between the cylinder bores 32 and parts therearound are effectively cooled, and in the part of the space on the inner side with respect to the spacer main body 41, the coolant mainly passes through the part on the upper side with respect to the step part 42 (coolant path). Thus, the upper part of the cylinder bore wall 32*a*, which is near the cylinder head 4 and where the temperature easily becomes high, can effectively be cooled.

The coolant which has passed through the intake-side half of the block-side jacket 33 and reached the right end flows into the head-side jacket 61 through the first communication openings 72*a* and 72*b*.

The coolant which has flowed into the head-side jacket 61 through the respective communication openings 72*a*, 72*b*, 73*a* to 73*c*, and 74*a* to 74*c* passes through the head-side jacket 61, and then is discharged to the outside of the engine 2 from the discharge port 62.

(6) Operation while Coolant Flow is Stopped

In this embodiment, in order to promptly increase the temperatures of the cylinder bore wall 32*a* and the cylinder head 4 and promptly achieve suitable combustion in the early stage of the warm-up operation of the engine 2, the flow of the coolant inside the water jackets 33 and 61 is stopped. Specifically, in this embodiment, a control unit for controlling the respective parts including the valve provided to the discharge port 62, and a detector for detecting the temperature of the coolant are provided. When the control unit determines that the temperature of the coolant detected by the detector is lower than a predetermined temperature, it outputs an instruction signal to close the valve.

Here, as described above, the water pump 5 is forcibly driven by the engine 2. Therefore, even when the flow of the coolant is stopped by closing the valve, the coolant is stirred around the introduction section 36 communicating with the water pump 5 due to the rotation of the water pump 5. When the coolant is stirred as above, near the introduction port 36*a*, there is a risk that the coolant at a comparatively high temperature on the upper side (i.e., cylinder head side) may cause a convective flow with the coolant at a comparatively low temperature on the lower side (i.e., counter cylinder head side) to be formed. Further, when the convective flow is formed near the introduction port 36*a* as above, the temperature of the cylinder bore 32 of the cylinder near the introduction port 36*a* becomes different from the temperature of the cylinder bore of the other cylinder, and the combustion state may vary between the cylinders. In other words, there is a risk that near the introduction port 36*a*, due to the stirring, the high-temperature coolant existing on the cylinder head side where the temperature is high in the cylinder block (i.e., the part close to the combustion chamber) may cause the convective flow with the comparatively low-temperature coolant existing on the counter cylinder head side (i.e., the part far from the combustion chamber), and, as a result, in the cylinder near the introduction port 36*a*, the temperature of the part near the combustion chamber may become lower than the other cylinders, and the temperature of the part far from the combustion chamber may become higher than the other cylinders.

On the other hand, in this embodiment, the first lateral wall 51 is provided to the position opposing the introduction port 36*a*, and the part of the space of the block-side jacket 33 between the introduction port 36*a* and the outer circumferential surface of the spacer main body 41 is partitioned into the upper and lower spaces by the first lateral wall 51. Therefore, the formation of the convective flow can be suppressed, and the temperature difference of the cylinder bore wall between the cylinders can be reduced.

Particularly in this embodiment, the first lateral wall 51 is disposed at the position opposing the upper end of the introduction port 36*a*. Therefore, the influence of the stirring by the water pump 5 can be controlled such that it only acts on the coolant below the first lateral wall 51, and the convective flow of the coolant in the up-and-down directions can surely be avoided.

Further, in this embodiment, the second lateral wall 52 is provided, and the part of the space of the block-side jacket 33 near the introduction port 36*a* is partitioned into the upper and lower spaces by the second lateral wall 52. Therefore, the convective flow can surely be avoided. In other words, in this embodiment, by using the second lateral wall 52 for splitting the coolant to the right side to lead to the cylinder head 4 side, and to the left side to the cylinder block 3 side, the convective flow can be suppressed.

Moreover, in this embodiment, since the step part 42 is provided over substantially the entire circumference of the spacer main body 41, and also in parts of the block-side jacket 33 other than the part near the introduction port 36*a*, the convective flow of the coolant in the up-and-down directions can be suppressed, and the temperature difference between the cylinders can more surely be reduced. Further, the decrease of the temperature of a part of the cylinder bore wall 32*a* on the upper side (i.e., cylinder head 4 side) and close to the combustion chamber by the convective flow can be reduced, and the temperature near the combustion chamber can promptly be increased. Particularly, since the step part 42 and the first lateral wall 51 are continuous and substantially the entire block-side jacket 33 is partitioned into the upper and lower spaces thereby, the convective flow can more surely be suppressed.

Moreover, in this embodiment, the spacer main body 41 extends in the up-and-down directions from the upper end to the lower end of the block-side jacket 33 and the entire block-side jacket 33 is partitioned into the inner and outer spaces. Therefore, when the convective flow occurs in the part of the block-side jacket 33 on the outer side with respect to the spacer main body 41, the influence of the convective flow on the inner space and further on the cylinder bore wall 32*a* can be suppressed. Moreover, the temperature difference between the cylinder bores 32 can be reduced. Further, since the introduction openings 45*a* to 45*c* and 46*a* to 46*c* are formed at the positions opposing the interval portions between the cylinder bores 32 of the spacer main body 41 while the entire block-side jacket 33 is partitioned into the inner and outer spaces can flow into the inner space of the block-side jacket 33 while suppressing the temperature difference to be small. Moreover, as described above, the interval portions can effectively be cooled.

(7) Modifications

Here, in this embodiment, the case where the step part 42 is provided to the spacer main body 41 and the block-side jacket 33 other than the part opposing the introduction port 36*a* is partitioned into the upper and lower spaces by the step part 42 is described; however, for example, the spacer main body 41 may be formed into a cylindrical shape extending straight in the up-and-down directions, and a partition wall protruding outward from a central part of the outer circumferential surface of the spacer main body 41 in the up-and-down directions may be provided over substantially the entire circumferential of the spacer main body 41.

However, by providing the step part 42 to the spacer main body 41 and disposing the upper part of the space main body 41 on the outer side compared to the lower part as this embodiment, the convective flow can be prevented with such a comparatively simple configuration, and the coolant which has flowed into the part of the block-side jacket 33 on the inner side of the spacer main body 41 can flow mainly to the upper space of the block-side jacket 33, in other words, the part that is close to the cylinder head 4 and where the temperature is comparatively high, and the cylinder bore wall 32*a* can effectively be cooled.

Moreover in this embodiment, the case where the first vertical wall 54 extending between the first and second lateral walls 51 and 52 in the up-and-down directions is disposed on the left side and the second vertical wall 55 extending downward from the second lateral wall 52 is disposed on the right side with respect to each other is described; however, the arrangement of the first and second vertical walls 54 and 55 in the left-and-right directions may be opposite.

Furthermore, in this embodiment, the cylinder bore wall 32*a* of the cylinders has the shape integrally formed and coupled at the interval portions between the cylinder bores; however, the present invention is applicable to multi-cylinder engines in which the cylinder bore wall 32*a* is independently formed for each of the cylinders.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

DESCRIPTION OF REFERENCE CHARACTERS

2 Engine
3 Cylinder Block
4 Cylinder Head
32 Cylinder Bore
32*a* Cylinder Bore Wall
33 Block-side Jacket (Water Jacket)
33*b* Jacket Outer Surface
40 Spacer Member
41 Spacer Main Body
42 Step Part (Partition Wall)
51 First Lateral Wall (Dividing Wall)
52 Second Lateral Wall (Flow Splitting Wall)
54 First Vertical Wall
55 Second Vertical Wall

What is claimed is:

1. A cooling structure of a multi-cylinder engine having a cylinder block formed with a plurality of cylinders and a cylinder bore wall of the plurality of cylinders, the cylinder block being fastened to a cylinder head, the cooling structure comprising:

a water jacket formed in the cylinder block and defined by the cylinder bore wall and a jacket outer surface surrounding the cylinder bore wall;

a water pump for feeding a coolant to the water jacket by being driven by the engine;

an introduction portion formed in the cylinder block, having an introduction port opening to the jacket outer surface, and for introducing, to the water jacket, the coolant fed by the water pump; and a spacer member accommodated inside the water jacket, wherein the spacer member has a spacer main body surrounding the cylinder bore wall, and a dividing wall protruding toward the jacket outer surface from an outer circumferential surface of the spacer main body, wherein the dividing wall extends in a circumferential direction of the spacer main body to a position proximate the introduction port, wherein the dividing wall extends out from the position proximate the introduction port so as to run facing the outer circumferential surface of the spacer main body and demarcate a cylinder head side space and a counter cylinder head side space on a side opposite from the cylinder head, wherein the cylinder head side space is adjacent to the introduction port and provided above the dividing wall and adjacent to the outer circumferential surface of the spacer main body, and wherein the counter cylinder head side space is adjacent to the introduction port and provided below the dividing wall.

2. The cooling structure of the multi-cylinder engine of claim 1, wherein the dividing wall is disposed to oppose an end part of the introduction port on a cylinder head side.

3. The cooling structure of the multi-cylinder engine of claim 1, wherein the plurality of cylinders are aligned in a predetermined cylinder aligning direction, wherein the introduction port is formed outward of one of the cylinders disposed at an end among the plurality of cylinders in the cylinder aligning direction, wherein the spacer member has a flow splitting wall, a first vertical wall, and a second vertical wall, each protruding toward the jacket outer surface from a part of the outer circumferential surface of the spacer main body opposing the introduction port, wherein the flow splitting wall has a shape which extends in the circumferential direction of the spacer main body, at a position further toward the opposite side from the cylinder head than the dividing wall, wherein the first vertical wall has a shape which extends toward the dividing wall from the flow splitting wall, wherein the second vertical wall has a shape which extends toward the opposite side from the cylinder head, from the flow splitting wall, and wherein the first and second vertical walls are disposed to be separated from each other in the cylinder aligning direction.

4. The cooling structure of the multi-cylinder engine of claim 1, wherein the spacer member has a partition wall protruding toward the jacket outer surface from the outer circumferential surface of the spacer main body, extending in the circumferential direction of the spacer main body to surround substantially an entire circumference of the spacer main body, so as to form a coolant path where the coolant flows, the coolant path formed between the outer circumferential surface of the spacer main body and the jacket outer surface on the opposite side from the cylinder head.

5. The cooling structure of the multi-cylinder engine of claim 4, wherein the partition wall is formed continuously from the dividing wall.

6. The cooling structure of the multi-cylinder engine of claim 4, wherein the spacer main body has a step part protruding toward the jacket outer surface from the outer circumferential surface of the spacer main body, and a part of the spacer main body on a cylinder head side with respect to the step part is disposed farther from the cylinders compared to a part of the spacer main body on the opposite side from the cylinder head side with respect to the step part, wherein the step part forms the partition wall, and wherein on the cylinder head side of the partition wall, a coolant path where the coolant flows is formed between an inner circumferential surface of the spacer main body and an outer circumferential surface of the cylinder bore wall by the partition wall.

7. The cooling structure of the multi-cylinder engine of claim 1, wherein the spacer main body extends from an end of the water jacket on the opposite side from the cylinder head, to an end of the water jacket on the cylinder head side, so as to partition the entire water jacket into a cylinder side space and a space on an opposite side from the cylinders, and wherein in the spacer main body, introduction openings are formed at positions opposing interval portions formed between cylinder bores of the cylinders, each of the introduction openings communicating a part of a space of the water jacket on the cylinder side with respect to the spacer main body to an other part of the space of the water jacket on the opposite side from the cylinder with respect to the spacer main body.

8. A cooling structure of a multi-cylinder engine having a cylinder block formed with a plurality of cylinders and a cylinder bore wall of the plurality of cylinders, the cylinder block being fastened to a cylinder head, the cooling structure comprising:

a water jacket formed in the cylinder block and defined by the cylinder bore wall and a jacket outer surface surrounding the cylinder bore wall;

a water pump for feeding a coolant to the water jacket by being driven by the engine;

an introduction portion formed in the cylinder block, having an introduction port opening to the jacket outer surface, and for introducing, to the water jacket, the coolant fed by the water pump; and a spacer member accommodated inside the water jacket, wherein the spacer member has a spacer main body surrounding the cylinder bore wall, and a dividing wall protruding toward the jacket outer surface from an outer circumferential surface of the spacer main body, wherein the dividing wall extends in a circumferential direction of the spacer main body to a position proximate the introduction port, wherein the dividing wall extends out from the position proximate the introduction port so as to run facing the outer circumferential surface of the spacer main body and demarcate a cylinder head side space adjacent to the introduction port and a space on a side opposite from the cylinder head and adjacent to the introduction port, and wherein the position proximate the introduction port is in a vicinity of the introduction port.

9. The cooling structure of the multi-cylinder engine of claim 1, wherein the dividing wall further comprises a first lateral wall and a second lateral wall, wherein the first and second lateral walls partition the bracketed space into the cylinder head side space and the counter cylinder side space, wherein the cylinder head side space is configured as an upper space, and wherein the counter cylinder head side space is configured as a lower space farther away from the cylinder head than the upper space.

10. The cooling structure of the multi-cylinder engine of claim 1, wherein the dividing wall extends out from the position proximate the introduction port so as to run in parallel to the outer circumferential surface of the spacer main body.

* * * * *